US010715939B2

(12) United States Patent
Lagally et al.

(10) Patent No.: US 10,715,939 B2
(45) Date of Patent: Jul. 14, 2020

(54) EARDRUM TRANSDUCER WITH NANOSCALE MEMBRANE

(71) Applicant: Wisconsin Alumni Research Foundation, Madison, WI (US)

(72) Inventors: Max Lagally, Madison, WI (US); Abhishek Bhat, Madison, WI (US); Frank Flack, Madison, WI (US); Shelley Scott, Madison, WI (US); Robert H. Blick, Hamburg (DE)

(73) Assignees: Wisconsin Alumni Research Foundation, Madison, WI (US); University of Hamburg, Hamburg (DE)

( * ) Notice: Subject to any disclaimer, the term of this patent is extended or adjusted under 35 U.S.C. 154(b) by 0 days.

(21) Appl. No.: 16/130,564

(22) Filed: Sep. 13, 2018

(65) Prior Publication Data

US 2020/0092666 A1 Mar. 19, 2020

(51) Int. Cl.
*H04R 25/00* (2006.01)
*B06B 1/06* (2006.01)
*H04R 25/02* (2006.01)

(52) U.S. Cl.
CPC ..... *H04R 25/606* (2013.01); *B06B 1/0662* (2013.01); *H04R 25/02* (2013.01); *H04R 25/65* (2013.01); *H04R 2460/13* (2013.01)

(58) Field of Classification Search
CPC ..... H04R 25/606; H04R 25/02; H04R 25/65; H04R 25/60; H04R 25/652; H04R 25/658; H04R 2460/13; B06B 1/0662
See application file for complete search history.

(56) References Cited

U.S. PATENT DOCUMENTS

| | | | | |
|---|---|---|---|---|
| 9,532,150 | B2 | 12/2016 | Blick et al. | |
| 2011/0170180 | A1 | 7/2011 | Turner et al. | |
| 2014/0254856 | A1* | 9/2014 | Blick | H04R 25/606 381/380 |
| 2017/0250671 | A1* | 8/2017 | Omura | H03H 3/08 |
| 2018/0324519 | A1* | 11/2018 | Park | H04R 1/24 |
| 2018/0329558 | A1* | 11/2018 | Park | G06F 3/0414 |

FOREIGN PATENT DOCUMENTS

| | | |
|---|---|---|
| CN | 101931850 B | 11/2012 |
| CN | 205693865 U | 11/2016 |
| CN | 207229350 U | 4/2018 |

OTHER PUBLICATIONS

Zhang et al.; "Vibrational modes of ultrathin carbon nanomembrane mechanical resonators." Applied Physics Letters 106, No. 6 (2015): 063107. pp. 1-6; US.
International Search Report & Written Opinion for Int'l Application PCT/US2019/047724.

* cited by examiner

*Primary Examiner* — Fan S Tsang
*Assistant Examiner* — Angelica M McKinney
(74) *Attorney, Agent, or Firm* — Boyle Fredrickson, S.C.

(57) ABSTRACT

A transducer supported by the eardrum provides a piezoelectric material exchanging energy with the eardrum through a nanoscale membrane, the latter serving to boost the coupling between the piezoelectric material and the eardrum.

18 Claims, 3 Drawing Sheets

EARDRUM TRANSDUCER WITH NANOSCALE MEMBRANE

BACKGROUND OF THE INVENTION

The present invention relates to electromechanical transducers and in particular to an audio transducer that may be applied directly to the eardrum.

Audio transducers convert electrical signals, for example, music or spoken voice, into audio waveforms perceptible by the human ear. A common audio transducer such as a "loudspeaker" provides an electric actuator such as a coil/magnet pair or piezoelectric material coupled to a diaphragm/horn providing coupling between the actuator and air.

Current hearing aids may employ a compact loudspeaker design converting electrical signals into pressure waves in the air that travel down the ear canal to induce vibrations in the eardrum (tympanic membrane). These vibrations are then conducted mechanically through structure of the inner ear, which can detect vibrations by special nerve cells. This need to couple the acoustic energy of the loudspeaker into the air increases the bulk of a hearing aid (required for the diaphragm/horn structure), which causes conversion inefficiencies, increasing the demand on and reducing the Life of the hearing-aid batteries.

U.S. Pat. No. 9,532,150, assigned to the assignee of the present application and hereby incorporated by reference, teaches an audio transducer with an electric actuator that can be applied directly to the eardrum, eliminating the need for the diaphragm/horn structure for coupling acoustic energy into the air. The ability to actuate this transducer, for example, wirelessly, raises the possibility of extremely compact and unobtrusive hearing aid designs.

The desirably small size of the electric actuator that can be supported on the eardrum and the likely low voltages available for driving that actuator present challenges with respect to providing sufficient stimulation of the eardrum for the hearing impaired.

SUMMARY OF THE INVENTION

The present invention advances the design described in U.S. Pat. No. 9,532,150 through the use of a nanoscale membrane that boosts the displacement of the eardrum through the process of constructive interference of converging surface waves generated by the piezoelectric material. An array of these nanoscale membranes permits coupling to the eardrum over a broad area.

In one embodiment, the present invention provides a transducer having a piezoelectric substrate sized to permit an inner surface of the piezoelectric substrate to be placed adjacent to a distal surface of an eardrum of a human ear. The piezoelectric substrate provides piezoelectric material distributed about an opening, and a set of electrodes is attached to the piezoelectric substrate to induce surface waves around the opening converging on a point in the opening. A nanoscale membrane is supported on the inner surface of the piezoelectric substrate and acoustically couples to the piezoelectric substrate over the opening in the piezoelectric substrate to conduct the induced surface waves to the point for constructive interference.

It is thus a feature of at least one embodiment of the invention to provide improved stimulation of the eardrum by a piezoelectric transducer through the use of an intervening nanoscale membrane combining mechanical surface waves by constructive addition.

The piezoelectric substrate may include multiple openings each having a corresponding set of electrodes and a nanoscale membrane.

It is thus a feature of at least one embodiment of the invention to provide multipoint stimulation of the eardrum to increase the stimulation thereof.

The multiple openings may have different sizes.

It is thus a feature of at least one embodiment of the invention to permit a tailoring of a profile of the stimulation of the eardrum through the use of different sizes of openings resulting in different factors of concentration of acoustic energy and a controllable stimulation profile.

The openings may pass through the piezoelectric substrate from an inner surface to the outer surface.

It is thus a feature of at least one embodiment of the invention to provide improved coupling of energy into the eardrum determined empirically to occur with through-openings.

The transducer may further include an antenna for receiving energy directed to the piezoelectric substrate and circuitry for applying phase signals to the set of electrodes to induce the surface waves.

It is thus a feature of at least one embodiment of the invention to provide a wireless lightweight transducer, for example, to produce an unobtrusive and energy efficient hearing aid or the like.

The nanoscale membrane may have a thickness of less than 1/10 or less than 1/100 or less than 1/1000 that of the piezoelectric substrate.

It is thus a feature of at least one embodiment of the invention to provide a transducer constructed from materials of different acoustic properties to maximize coupling to the eardrum with reduced weight compared to a transducer exclusively using piezoelectric material.

The piezoelectric substrate may have a thickness less than or equal to the thickness of an average human eardrum.

It is thus a feature of at least one embodiment of the invention to provide a lightweight transducer minimizing disruption of the normal acoustic properties of the eardrum.

The nanoscale membrane may be a semiconductor material.

It is thus a feature of at least one embodiment of the invention to provide a transducer material suitable as a substrate for fabrication circuitry and electrodes.

The nanoscale membrane may be silicon.

It is thus a feature of at least one embodiment of the invention to provide a nanoscale membrane having good mechanical properties to couple surface waves from a piezoelectric material.

The nanoscale membrane may have a thickness of 1-100,000 nanometers.

It is thus a feature of at least one embodiment of the invention to provide a material thickness that may be versatility tailored to provide acoustic transmission of surface waves as well as good energy transfer to the eardrum.

The piezoelectric substrate may have a thickness from 5 to 500 micrometers.

It is thus a feature of at least one embodiment of the invention to provide an extremely lightweight transducer that can be carried comfortably within the ear canal adjacent to the eardrum. The opening may circumscribe an area of a circle having a diameter from 10 to 1000 micrometers.

It is thus a feature of at least one embodiment of the invention to permit tailoring of the size of the openings in the piezoelectric substrate for the desired degree of amplitude boosting.

The transducer may include a biocompatible coating over the nanoscale membrane.

It is thus a feature of at least one embodiment of the invention to permit close contact between the eardrum and the nanoscale membrane of the device.

The opening may be circular and the electrodes may be concentric circles of different diameters about the point. It is thus a feature of at least one embodiment of the invention to provide a simple geometry for energy concentration.

The transducer electrodes may be excited with phased waveforms having a fundamental frequency in excess of 100 kilohertz and modulated at an audio frequency so that the surface waves have a frequency above the audio frequency, which can be amplitude and/or frequency modulated.

It is thus a feature of at least one embodiment of the invention to provide efficient energy transfer to the transducer using higher frequencies than the transmitted audio frequencies, thereby enabling smaller antenna sizes.

The modulation may be amplitude modulation.

It is thus a feature of at least one embodiment of the invention to provide a modulation technique that can be directly demodulated using the structure of the transducer without necessarily requiring additional demodulation circuitry, although the invention also contemplates the use of demodulation circuitry, for example, formed using integrated circuit techniques on the transducer.

The phased waveforms may have a fundamental frequency in excess of 100 megahertz.

It is thus a feature of at least one embodiment of the invention to provide wireless power transfer at a frequency suitable for transmission of power through the ear canal.

These and other objects, advantages and aspects of the invention will become apparent from the following description. The particular objects and advantages described herein may apply to only some embodiments falling within the claims and thus do not define the scope of the invention. In the description, reference is made to the accompanying drawings, which form a part hereof, and in which there is shown a preferred embodiment of the invention. Such embodiment does not necessarily represent the full scope of the invention and reference is made, therefore, to the claims herein for interpreting the scope of the invention.

DETAILED DESCRIPTION OF THE PREFERRED EMBODIMENT

Figure 1:
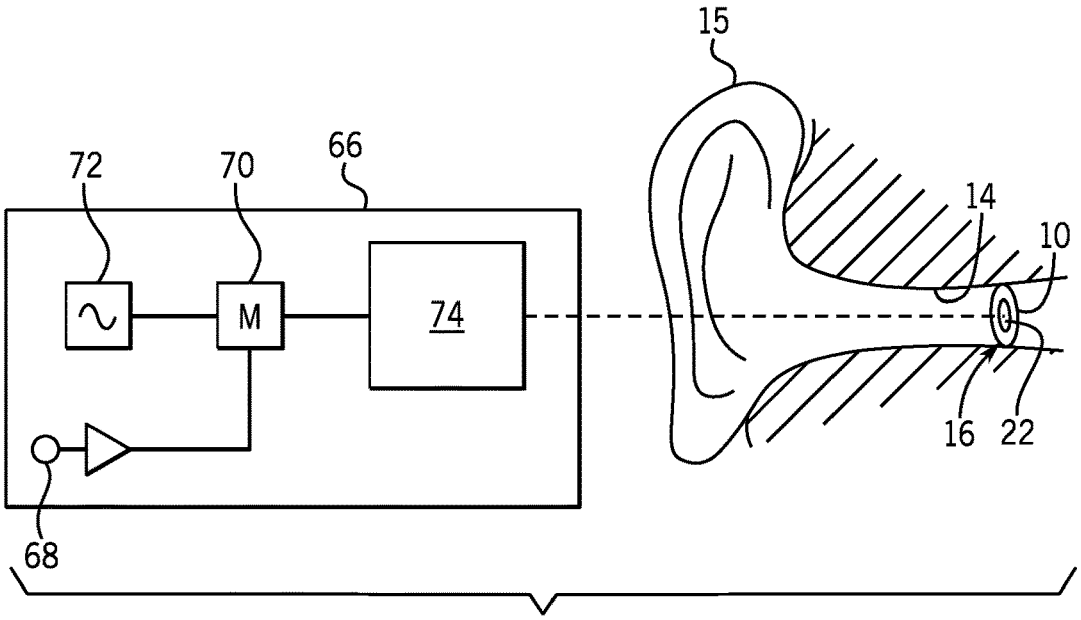
FIG. 1 is a perspective, simplified view of the eardrum and ear canal showing an audio transducer of the present invention attached to the eardrum and communicating wirelessly with an external power source.

Referring now to FIG. 1, a human eardrum 10 may span the end of an ear canal 14, the latter passing into the head from the outer ear 15. Working together, the outer ear 15, ear canal 14, and eardrum 10 capture airborne audio compression waves (not shown), which apply pressure to the distal surface 16 of the eardrum 10. A proximal surface of the eardrum 10 may contact a malleus bone (not shown) for communication of vibratory signals from the eardrum 10 to an inner ear structure that may sense those vibrations.

An audio transducer 22 of the present invention provides for a small, lightweight piezoelectric substrate 24 whose inner surface 18 may attach to a distal surface 16 of the eardrum 10, for example, through cohesive forces between the inner surface 18 of the transducer 22 and the abutting distal surface 16 of the eardrum 10, such cohesive forces promoted by moisture or oils on the distal surface 16 of the eardrum 10 or by biocompatible adhesive, or the like. Alternatively, the audio transducer 22 may have portions attached to the ear canal 14 so as to position the audio transducer 22 against the eardrum 10 as will be discussed. In both cases, the light weight of the audio transducer 22 permits free vibration of the eardrum 10 to reduce modification to the acoustic properties of the eardrum 10. Alternatively or in addition, the audio transducer 22 may provide for posts or pins that can be inserted into the eardrum 10 to fixate the device or control its standoff from the eardrum 10 for acoustic tuning.

The audio transducer 22, in one embodiment, may be a substantially circular disk having a diameter within the range of 0.5 millimeter to 10 millimeters, and in one embodiment substantially 1.5 millimeters in width and height, so that it may be placed on the distal surface 16 of the eardrum 10 close to a center of the eardrum 10. The audio transducer 22 may have a thickness within a range of 5 to 100 micrometers and, in a preferred embodiment, a thickness of substantially 10 micrometers. It is expected that the thickness of the audio transducer 22 will be less than or equal to 1/10 the thickness of the average human eardrum or less than about 10 microns. The invention contemplates the advantage of even thinner audio transducers 22, for example, less than 1/100 or 1/1000 of the thickness of the human eardrum and does not exclude embodiments Where the transducer is thicker than the human eardrum. Although a disk shape is described, the invention contemplates other configurations, for example, a rectangular shape.

Figure 2:
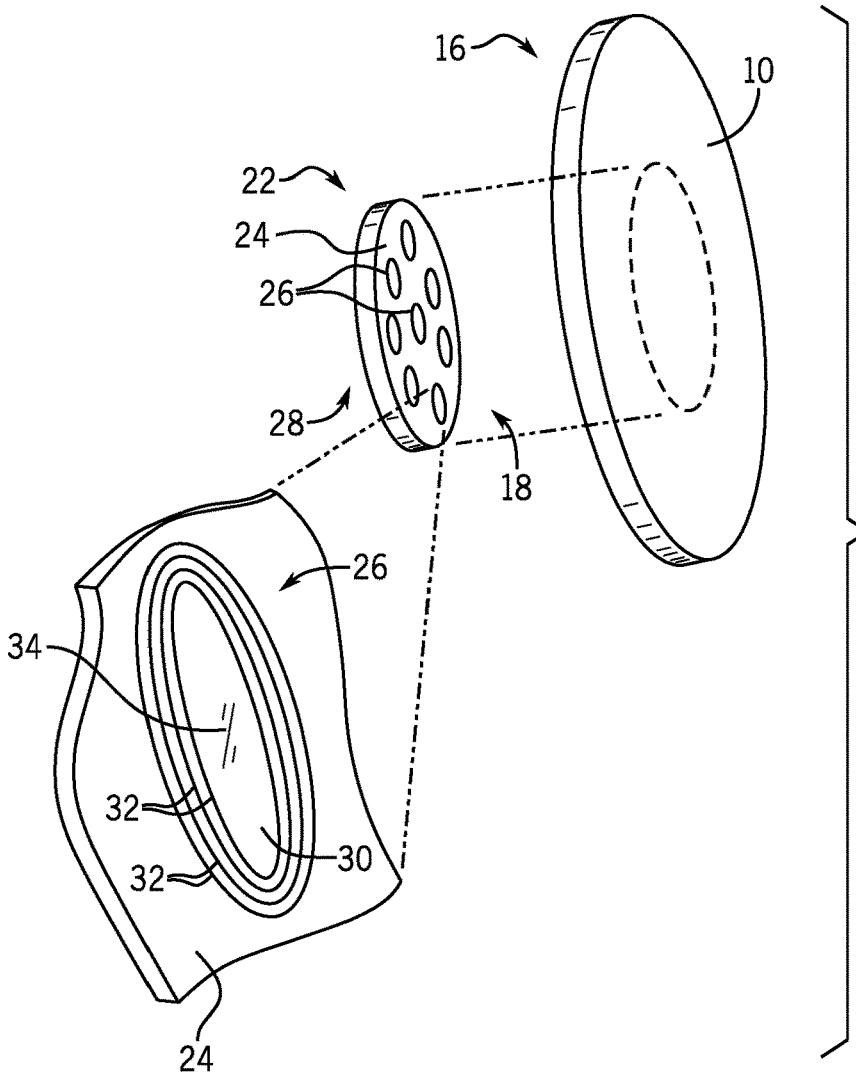
FIG. 2 is an exploded perspective view of the transducer and eardrum of FIG. 1, the transducer providing multiple openings in a piezoelectric substrate, each opening covered by a corresponding nanoscale membrane and showing (in inset) concentric circular electrodes on the material of the piezoelectric substrate outside of the openings for generating converging surface acoustic waves.

Referring now also to FIG. 2, the piezoelectric substrate 24 is constructed from a material having a large piezoelectric coefficient, such as lead zirconium titanate (PZT), thin polymer polyvinylidene (PVDF), or other similar materials.

Piezoelectricity refers to the charge that accumulates in certain solid materials, such as crystals, in response to applied mechanical stress. The piezoelectric effect is such that substrates exhibiting the piezoelectric effect to generate electrical charge from an applied mechanical force also exhibit the reverse piezoelectric effect, that is, internal generation of a mechanical strain from an applied electrical field. This latter effect is used in the present invention.

In one embodiment, the piezoelectric substrate 24 provides multiple-through openings 26 passing from the inner surface 18 to an outer surface 28 of the piezoelectric substrate 24. These openings may have a diameter from 10 to 1000 micrometers in one embodiment or an equivalent area when they are noncircular.

Each of the openings 26 may be covered on the inner surface 18 with a nanoscale membrane 30, this nanoscale membrane 30 attached at its outer periphery to the inner periphery of a corresponding opening 26 and therefore acoustically coupled to the material of the piezoelectric substrate 24. The nanoscale membranes 30 may have a thickness less than or equal to 1/10 (or less than 1/10,000) of that of the piezoelectric substrate 24 and generally a thickness from 1 to 10,000 nanometers. Methods of fabricating a nanoscale membrane 30 of silicon are described, for example, in U.S. Pat. Application No. 2011/0170180 to Turner citing U.S. Pat. No. 6,372,609 to Aga et al., all hereby incorporated by reference. The invention contemplates that a wide range of different materials may be used for the nanoscale membrane 30 including semiconductors with various types and degrees of doping, semi metals, and the like.

Surrounding each of the openings 26 are set of circular, concentric electrodes 32, for example, formed by doped regions in the material of the piezoelectric substrate 24 or by metallization layers applied to the piezoelectric substrate 24, in either case using standard integrated-circuit fabrication techniques. The same integrated-circuit fabrication techniques may be used to place circuitry on the piezoelectric substrate 24 including resistors, capacitors, diodes, inductors, and transistor devices of types generally known in the art, although such circuitry is not required in the simplest embodiment of the invention.

Figure 3:
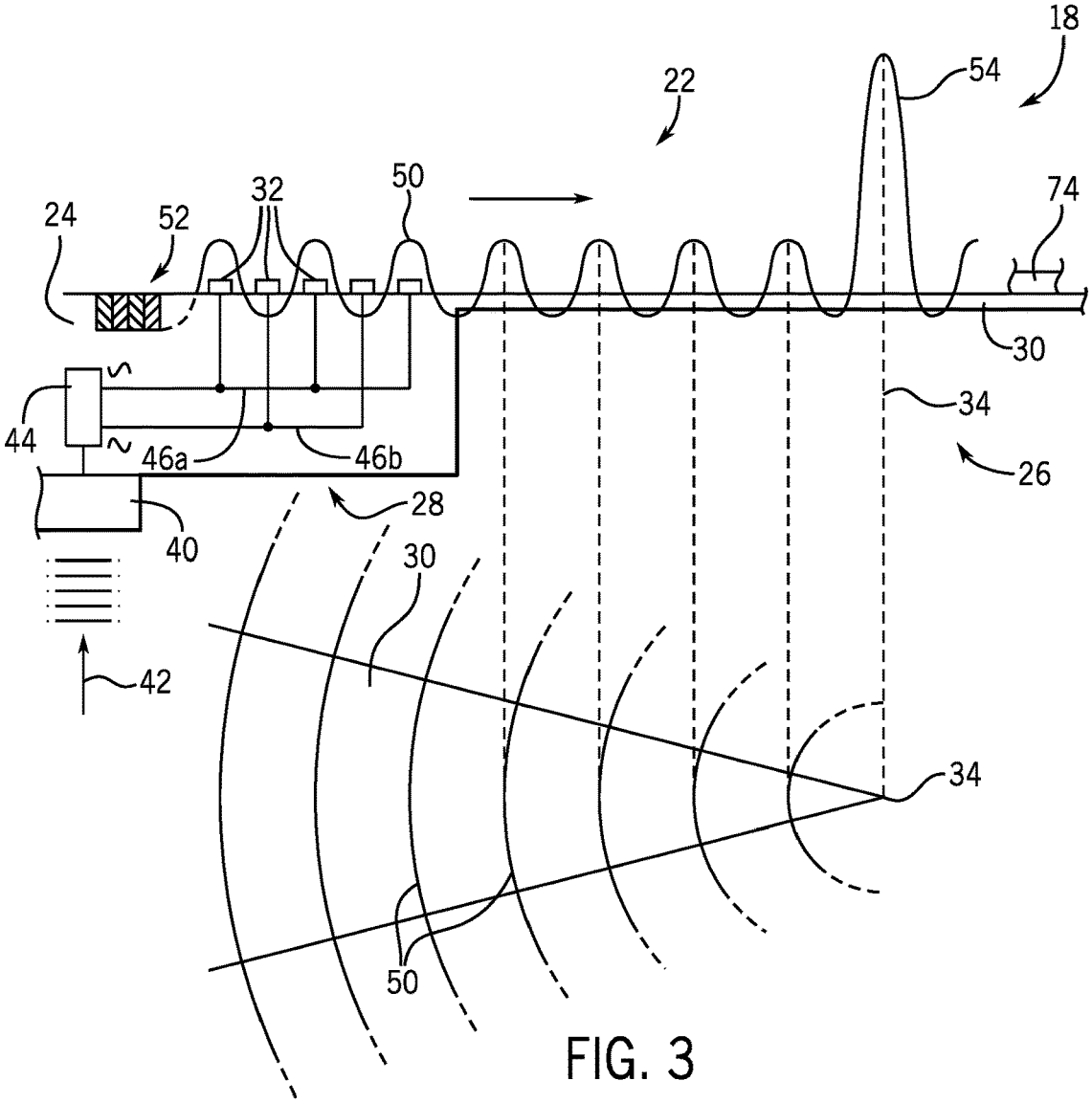
FIG. 3 is a fragmentary cross-section through one opening of the piezoelectric substrate of FIG. 2 showing excitation of the electrodes to provide surface waves extending into the nanoscale membrane for constructive addition at a center of the nanoscale membrane, the cross-section positioned over a fragmentary rear plan view of the transducer showing the convergence of wave energy such as to increase the amplitude of the waves at the center of the nanoscale membrane.

The electrodes 32 receive phased electrical voltages for stimulating the piezoelectric substrate 24 to produce surface waves converging at a center 34 of the opening 26. Referring now to FIG. 3, more specifically, during operation one embodiment of the transducer 22 may receive electrical signals collected at an antenna 40 positioned on the outer surface 2$ of the piezoelectric substrate 24. In one embodiment, the antenna 40 may receive wireless signals 42 having a fundamental frequency in excess of 100 kilohertz. In this regard, the antenna 40 may be any of a capacitive plate for receiving near-field communication (and far-field communication) in a distance range from 1 to 100 centimeters, capacitively transmitted electrical signals 42, a loop or spiral antenna for receiving near-field electromagnetic signals, or a dipole antenna or its known variations for receiving far-field radio signals.

Beyond the wireless receipt of electrical energy, the invention further contemplates direct electrical communication of energy to the piezoelectric substrate 24 using fine electrical conductors, for example, communicating with an external power source or communicating with a separate antenna (not shown) removed from the piezoelectric substrate 24, for example, positioned elsewhere in the ear canal 14 or on the outer ear 15. Alternatively, the antenna 40 may be configured for the receipt of high-frequency electromagnetic signals in the form of light, for example, from a laser or high-intensity LED positioned near the outer ear 15 or in the ear canal 14, the antenna 40 providing a photodetector or the like.

Electrical signals collected by the antenna 40 are transmitted along conductors or circuitry 44 to provide bipolar signals **46*a* and 46*b* applied to alternative ones of the electrodes 32. The conductors or circuitry 44 may, in the simplest case, provide a grounding of alternate electrodes 32 and an alternating radiofrequency signal to the remaining electrodes 32. Alternatively, the conductors or circuitry 44 may implement a delay line to provide out of phase signals to alternate electrodes 32. Alternatively the invention contemplates the possibility of a local ring or similar oscillator circuit for this purpose operating on power received from the antenna 40 or the like and modulated by a separate signal. In some embodiments, the conductors or circuitry 44 may be formed as part of the antenna 40 itself. It will be appreciated that the spacing of the electrodes 32 along the surface of the piezoelectric substrate 24 will be a function of the wavelength of the shear wave 50, for example, the spacing desirably being a quarter wavelength, this wavelength in turn being a function of the carrier frequency and the shear wave sound speed in the piezoelectric substrate 24. Generally the piezoelectric substrate 24 and the nanoscale membrane 30** will have comparable sound speed for improved energy transfer but these sound speeds need not be identical.

In all cases, the alternate electrodes 32 may be driven electrically to provide local piezoelectric effects on the surface of the piezoelectric substrate 24 producing a surface shear wave 50 propagating inward toward the center 34 along a plane of the nanoscale membrane 30 as well as outward through the piezoelectric substrate 24.

As stimulated, the interdigitated electrodes 32 may produce a transmitter portion of a surface acoustic wave ("SAW") device. A surface acoustic wave may be considered an acoustic wave traveling along the surface of a material exhibiting elasticity, the acoustic wave having an amplitude that typically decays exponentially with depth into the substrate. Surface acoustic waves produced in piezoelectric substrates in nanoscale electromechanical systems are described in "Acoustic Waves—From Microdevices to Helioseismology," Chapter 28 ("Surface Acoustic Waves and Nano-Electromechanical Systems," D. J. Kreft and R. H. Buck), edited by Prof. M. G. Beghi, November 2011, which material is expressly incorporated by reference.

The surface waves extending outward from the electrodes 32 with respect to the opening 26 may be blocked by an optional reflector/damper 52 placed around the electrodes 32 to constrain or damp the outwardly extending wave to prevent interference with adjacent structures. The reflector/damper 52, for example, may be formed by successive layers of different acoustic impedance material to create a Bragg-like mirror or to operate analogously to optical anti-reflection coatings in the acoustic domain. In one approach a set of patterned and spaced metal strips can provide this reflection. Alternatively or in addition, the reflector/damper 52 may be formed of a lossy material having high acoustic absorption.

The inwardly directed surface waves 50 are conducted into the nanoscale membrane 30 where they converge on the center 34 of the nanoscale membrane 30 to constructively add at the center 34 of the nanoscale membrane 30 producing a high-amplitude excursion 54 having an amplitude (measured perpendicular to the plane of surface of 18) many times higher than the surface waves 50 at the periphery of the nanoscale membrane 30. Simulations suggest that a five nanometers thick nanoscale membrane 30 can be induced to provide high-amplitude excursions 54 in excess of 30 nanometers. This amplitude boosting is provided not only by the constructive addition of surface waves 50 at the center 34 of the nanoscale membrane 30 but also by the convergence of the energy input to the nanoscale membrane 30 at its periphery, as that energy travels in the form of circular surface waves 50 of decreasing diameter as they converge to the center 34 of the nanoscale membrane 30, which focuses the energy of the surface waves 50.

While the inventors do not wish to be bound by a particular theory, the concentration of energy in the high-amplitude excursion 54 of the nanoscale membrane 30 may provide improved coupling to the eardrum 10 by providing higher-amplitude motion of the eardrum 10. By providing higher amplitude motion, possible nonlinearities in the coupling of energy to the eardrum 10 which attenuate or absorb lower-amplitude excursions of the nanoscale membrane 30 can be avoided.

Figure 4:
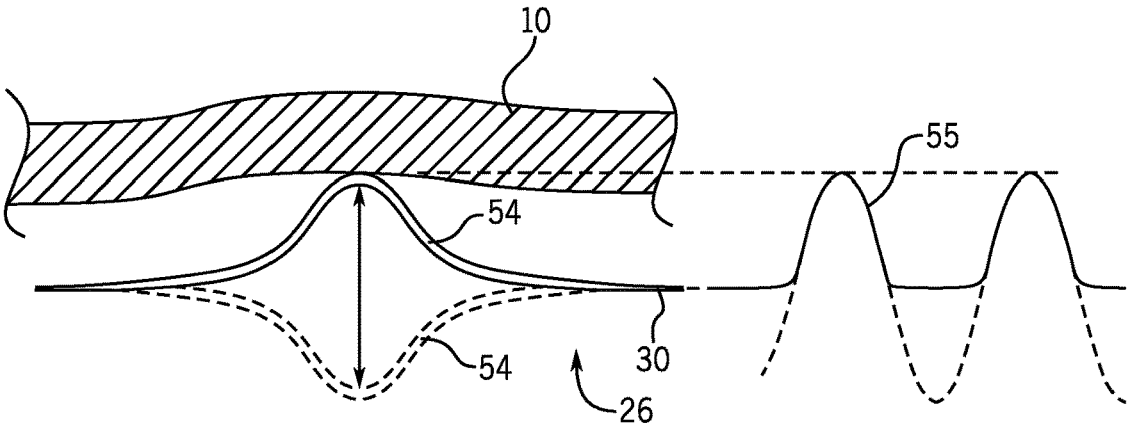
FIG. 4 is a detailed cross-section similar to FIG. 3 showing constructive addition of surface waves to press inward (upward in this view) on the eardrum in a first half cycle and to separate from the eardrum in the second half cycle to produce a demodulating rectification suitable for demodulating amplitude modulation.

Referring now to FIG. 4, the high-amplitude excursion 54 is believed to decouple or separate from the eardrum 10 every half cycle as this high-amplitude excursion 54 moves away from the eardrum 10 providing a local separation between the eardrum 10 and the nanoscale membrane 30. This decoupling may occur because motion by the eardrum 10 following a retreating nanoscale membrane 30 is blocked by the crests of the surface waves 50 elsewhere on the nanoscale membrane 30. In that case, the eardrum 10 stops against the inner surface 18 of the piezoelectric substrate 24. Alternatively or in addition, the high-amplitude excursion 54 of the nanoscale membrane 30 as it retreats from the eardrum 10 may separate from the eardrum 10 under the retarding inertial forces of the mass of the eardrum 10 as may overcome local forces of adhesion near the center of the nanoscale membrane 30. The result, in either case, is an effective rectification of the energy coupled to the eardrum 10 shown by an excursion line 55 plotted to the side of the cross sectional depiction of the eardrum 10 of FIG. 4.

Figure 5:
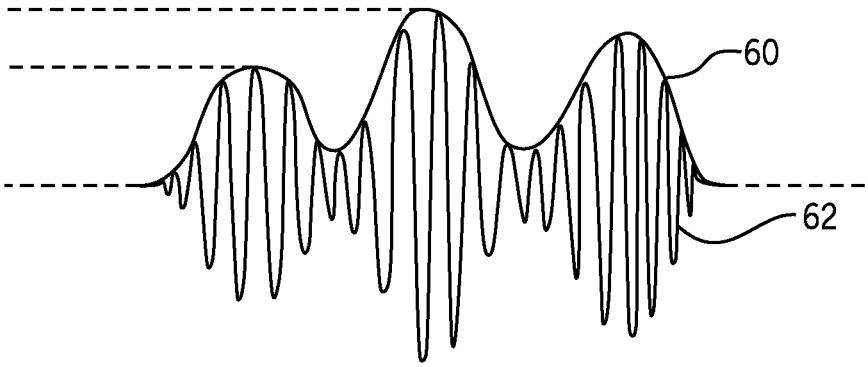
FIG. 5 is a simplified diagram of an amplitude modulated signal suitable for use in exciting the electrodes of FIG. 2.

Referring momentarily to FIG. 5, this rectification permits demodulation of an amplitude modulation of the surface waves 50, for example, as modulated by an audio signal 60 in a frequency range perceptible by the human ear. As is understood in the art, amplitude modulation provides an envelope of the instantaneous peaks of a carrier signal 62, the latter being of much higher frequency than the audio signal 60. The frequency of the carrier signal 62 is preferably in excess of 100 kilohertz and ideally in excess of one megahertz with the preferred range centered around 433 megahertz±20 percent.

In one embodiment, the carrier signal 62 has the same frequency as the surface waves 50 simplifying construction of the transducer 22. In this case, the high-amplitude excursion 54 may also be amplitude modulated and this modulation demodulated by the rectification action described with respect to FIG. 4. The rectified audio signal includes a portion of the carrier signal 62 which is effectively attenuated by the eardrum 10 which can only respond to audio frequencies (because of its inertia and elasticity) allowing the eardrum 10 to experience the extracted audio signal 60 only representing net excitation of the eardrum 10.

Referring again to FIG. 1, the wireless signal 42 producing the surface waves 50 may be generated outside of the outer ear 15, for example, in a portable device such as a cell phone or the like, or in an ear-mounted device following the design of a hearing aid. This portable device may receive an electrical signal, for example, at input 6$, representing the audio signal 60 such as speech or music, for example, obtained from a microphone, music player, or other electronic device. The audio signal 60 is received by an amplitude modulator 70 modulating a carrier signal from carrier oscillator 72 operating to produce a carrier signal 62 described with respect to FIG. 5. In this modulation, the audio signal 60 defines an envelope of the peaks of the carrier signal 62.

A modulated signal output from the modulator 70 is fed to a transmission antenna 74, for example, being a complement to any of the receiving antennas discussed above including, for example, a capacitor plate, a magnetic induction loop, a dipole or similar far-field transmitter, or a light or laser output.

Figure 6:
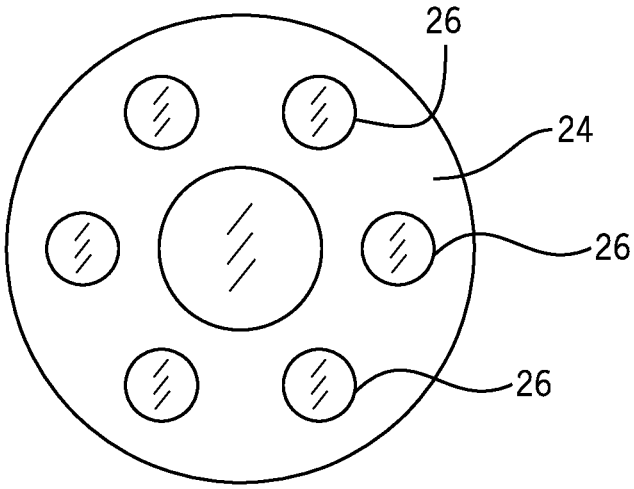
FIG. 6 is a rear plan view of an alternative embodiment of the transducer having varied opening sizes.

Referring now to FIG. 6, it will be appreciated that the size and placement of the openings 26 in the piezoelectric substrate 24 may be varied within an expected result of producing nanoscale membranes 30 having different magnitudes of high-amplitude excursions 54. The overall profile may be better tailored to the eardrum 10, for example, profiled to better support the eardrum 10 in a tent-like fashion or adapted to address particular conditions of particular human patients, for example, regions of sensitivity or insensitivity of the eardrum 10 with respect to coupled vibrations. Although a circular outline of the piezoelectric substrate 24 is shown with a circular arrangement of the openings 26, other shapes including squares and other arrangements of the openings 26, for example, in rows and columns, may be adopted for ease of fabrication, improved performance or the like.

Referring again to FIG. 3, outer surfaces of the transducer 22 may be coated with a biocompatible material 74 such as a Parylene, preventing direct contact between non-biocompatible materials of the nanoscale membrane 30 and tissue of the eardrum 10. Alternatively, this coating may be applied solely on an inner surface 18 of the transducer 22 in contact with the distal surface 16 of the eardrum 10.

While it is believed that simple amplitude modulation of wirelessly transmitted energy to the transducer 22 is well adapted to this design, it will be appreciated that more advanced digital techniques such as pulse code modulation and frequency modulation may also be used with appropriate circuitry on the piezoelectric substrate 24 to transmit and demodulate audio information using scavenged electrical power from the antennas 40.

One or more specific embodiments of the present invention have been described above. It is specifically intended that the present invention not be limited to the embodiments and/or illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the present invention unless explicitly indicated as being "critical" or "essential,"

Certain terminology is used herein for purposes of reference only, and thus is not intended to be limiting. For example, terms such as "upper," "lower," "above," and "below" refer to directions in the drawings to which reference is made. Terms such as "front," "back," "rear," "bottom," "side," "left" and "right" describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second" and other such numerical terms referring to structures do not imply a sequence or order unless clearly indicated by the context.

When introducing elements or features of the present disclosure and the exemplary embodiments, the articles "a," "an," "the" and "said" are intended to mean that there are one or more of such elements or features. The terms "comprising," "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as coming within the scope of the following claims. All of the publications described herein including patents and non-patent publications are hereby incorporated herein by reference in their entireties.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

We claim:

1. A transducer comprising:

a substrate sized to permit an inner surface of the substrate to be placed adjacent to a distal surface of an eardrum of a human ear to be supported by that distal surface, the substrate providing:

piezoelectric material distributed about an opening in the substrate;

a set of electrodes communicating with the piezoelectric material to electrically induce surface waves in the piezoelectric material around and not electrically induce surface waves within the opening, the surface waves directed to converge on a point in the opening; and a nanoscale membrane supported on the inner surface of the piezoelectric material covering the opening and acoustically coupled to the piezoelectric material around the opening to conduct the induced surface waves from the piezoelectric material into the nanoscale membrane to the point for constructive interference.

2. The transducer of claim 1 wherein the substrate includes multiple openings each having a corresponding set of electrodes and nanoscale membrane.

3. The transducer of claim 2 wherein the multiple openings have different sizes.

4. The transducer of claim 1 wherein the opening passes through the substrate from the inner surface to an outer surface opposite the inner surface.

5. The transducer of claim 1 further including an antenna for receiving energy directed to the substrate and circuitry for applying phase signals to the set of electrodes to induce the surface waves.

6. The transducer of claim 1 wherein the nanoscale membrane has a thickness of less than 1/10 that of the piezoelectric substrate.

7. The transducer of claim 1 wherein the substrate has a thickness less than or equal to an average human eardrum.

8. The transducer of claim 1 wherein the nanoscale membrane is a semiconductor material.

9. The transducer of claim 8 wherein the nanoscale membrane is silicon.

10. The transducer of claim 1 wherein the nanoscale membrane has a thickness of 1-1000 nanometers.

11. The transducer of claim 1 wherein the substrate has a thickness from 5 to 100 micrometers.

12. The transducer of claim 1 wherein the opening circumscribes an area of a circle having a diameter from 10 to 1000 micrometers.

13. The transducer of claim 1 further including a biocompatible coating over the nanoscale membrane.

14. The transducer of claim 1 wherein the opening is circular and wherein the electrodes are concentric circles of different diameters about the point.

15. A method of communicating audio comprising:

(a) attaching a transducer adjacent to an eardrum of a human to be supported on the eardrum, the transducer comprising:

piezoelectric material distributed about an opening;

a set of electrodes attached to the piezoelectric material to electrically induce surface waves in the piezoelectric material around the opening and not electrically induce surface wave within the opening, the surface waves directed to converge on a point in the opening in the substrate; and a nanoscale membrane in contact with the eardrum and supported on an inner surface of the piezoelectric material covering the opening and acoustically coupled to the piezoelectric material around the opening to conduct the induced surface waves from piezoelectric material into the nanoscale membrane to the point for constructive interference; and (h) exciting the set of electrodes with phased waveforms having a fundamental frequency in excess of 100 kilohertz and modulated at an audio frequency wherein the surface waves have a frequency above the audio frequency.

16. The method of claim 15 wherein the modulation is amplitude modulation.

17. The method of claim 15 wherein the transducer further includes an antenna communicating with the set of electrodes for receiving electromagnetic energy.

18. The method of claim 15 wherein the phased waveforms may have a fundamental frequency in excess of 100 megahertz.

* * * * *